United States Patent [19]

Webb et al.

[11] Patent Number: 4,925,408

[45] Date of Patent: May 15, 1990

[54] INTAKE AND PUMP ASSEMBLY FOR AQUATIC VEHICLE

[75] Inventors: Edward Webb, Paynesville, Minn.; Marley Duclo, Hotchkiss, Colo.

[73] Assignee: Koronis Parts, Inc., Paynesville, Minn.

[21] Appl. No.: 96,555

[22] Filed: Sep. 14, 1987

[51] Int. Cl.[5] ..... B63H 11/02

[52] U.S. Cl. ..... 440/38

[58] Field of Search ..... 440/38, 47; 415/174, 415/9; 417/360, 363, 364; 60/221; 285/405, 412, 363, 368, 330

[56] References Cited

U.S. PATENT DOCUMENTS

| | | | |
|---|---|---|---|
| 3,249,083 | 5/1966 | Irgens | 440/47 |
| 3,283,737 | 11/1966 | Gongwer | 440/47 |
| 3,287,032 | 11/1966 | Kraybill | 385/330 |
| 3,405,526 | 10/1968 | Aschauer | 440/47 |
| 3,590,766 | 7/1971 | Jackson | 440/38 |
| 3,827,392 | 8/1974 | Jones | 440/38 |
| 3,993,015 | 11/1976 | Klepacz | 440/97 |
| 4,634,391 | 1/1987 | Entringer | 440/83 |

*Primary Examiner*—Joseph F. Peters, Jr.
*Assistant Examiner*—Edwin L. Swinehart
*Attorney, Agent, or Firm*—Merchant, Gould, Smith, Edell, Welter & Schmidt

[57] ABSTRACT

Disclosed is an intake and pump assembly (101) for an aquatic vehicle (10) and a method for disassembling an intake and pump assembly. The intake and pump assembly (101) includes an intake housing (18), a pump body (66), and a discharge nozzle (79). The intake housing (18) is provided with an intake grill (89) and flow director (85). The impeller (17) is surrounded by a wear ring (58). A vane (72) is integrally formed within the pump body (66). The drive shaft assembly (37) is provided with couplers (30, 33) and ball guides (26, 50 ) of resilient material which interconnect the component parts of the drive shaft assembly (37) and absorb shock and misalignment. Stacked washers (61) are provided for adjustment purposes.

6 Claims, 6 Drawing Sheets

INTAKE AND PUMP ASSEMBLY FOR AQUATIC VEHICLE

FIELD OF THE INVENTION

The present invention relates generally to an intake and jet pump assembly for a water craft, and more particularly to a centrifugal jet pump having a flow director, vane, and optional intake grill which efficiently channels water at high velocity to power the water craft.

BACKGROUND OF THE INVENTION

Various types of water jet power driven, aquatic vehicles have been devised and used. These vehicles are popular because of their speed, exceptional maneuverability, compact size, inexpensiveness, and appeal to all ages.

Water jet propelled boats are conventionally provided with a pump mounted within the craft. The pump is typically provided with an outlet near the stern of the boat for directing a jet of water rearwardly from the boat in order to propel the boat forwardly. The typical water inlet means for these pumps has been in the form of (1) scoops projecting below the planing surface of the boat hull and opening forwardly in order to enable the forward speed of the boat to assist in delivering the desired quantity of water to the pump; (2) forwardly opening recesses formed in the forward portions of the boat hull below the water line which enable the forward movement of the boat to assist in delivering the desired quantity of water to the water pump; and (3) openings in the bottom of the boat, usually one or two in number, which rely heavily upon the angle of attack of the bottom of the boat and the suction effected by the pump for delivering water to the pump.

The performance of these water jet propelled boats is limited by the means employed for converting the power output of the engine to thrust for propelling the water craft. Conventional propellers and pumps have been found to be inefficient due to cavitation losses, causing a great power loss. Cavitation occurs when vapor bubbles in a swiftly moving body of liquid impinge against a solid surface such as an impeller. The violent collapse of the vapor bubbles can blast particles of the metal out, causing the metal to develop a pitted or spongy appearance. In addition to causing the parts to become rapidly eroded, cavitation can also result in a drop in the performance of the jet pump by lowering efficiency and producing noise and vibrations.

However, conventional water jet pumps are typically difficult to disassemble for maintenance purposes. They are usually made of a heavy material, and the component parts are typically bolted together. As a result, it takes a long period of time to disassemble the pump assembly for maintenance or inspection purposes. In addition, the complexity of the connections is often too difficult for the ordinary consumer to master.

Further, conventional metal pumps tend to corrode and have a significant number of casting irregularities or rough surfaces which reduce efficiency. To improve efficiently, the owner of the watercraft often attempts to have this problem corrected by a process called "blueprinting", which results in additional cost and inconvenience.

Another problem with conventional jet pump powered water vehicles is the failure to entrain water during sharp cornering. This results in a crucial lack of motive force at the most steeply banked portion of a turn and lateral instability. This lack of continuous jet pump action during a turn contributes to a loss of control of the water vehicle and is a safety hazard. Proper water entrainment is essential to the operation of a jet pump throughout its entire performance range.

Conventional jet pumps used with small watercraft also typically do not feature a wear ring around the impeller. The absence of a wear ring results in the wear of the pump housing itself, so that the entire pump housing must be periodically replaced. This is an inconvenient and expensive proposition. Further, if a wear ring is provided, it is typically made of stainless steel and is not tapered. As a result, the wear ring is difficult to remove from the intake housing, so that it is difficult to reach the impeller for inspection and maintenance purposes.

Conventional jet pumps are also typically made from relatively heavy parts, and the additional weight requires more power from the engine. This problem is magnified when a jet pump is used with a small watercraft having a relatively small engine.

The present invention addresses the above problems associated with currently available jet pump assemblies.

SUMMARY OF THE INVENTION

The present invention comprises an intake and pump assembly for an aquatic vehicle. The assembly comprises a smooth, streamlined intake housing having a bottom opening and an intake grill through which water enters. The intake housing directs the water through an impeller which is surrounded by a plastic, removable wear ring proximate the rear end of the intake housing. A pump body with an integral vane directs the water from the impeller and through a discharge nozzle at the rear of the watercraft to power the aquatic vehicle. According to one aspect of the invention, a flow directing grill intake is provided with a concave upper surface to efficiently direct the water to the impeller and to reduce cavitation. According to another aspect of the invention, a drive shaft assembly is provided with couplers of resilient material which interconnect component parts, whereby the couplers of the present invention absorb shock and misalignment. The present invention also includes a method for disassembling the intake and pump assembly, comprising the steps of removing a band clamp, and removing the pump body from the intake housing in order to expose the wear ring and impeller for inspection and maintenance purposes.

A particular advantage of the present invention is its ease of maintenance. It is often necessary to reach the area around the impeller for various reasons, such as cleaning out debris, replacing the impeller after it was damaged by a rock, or for routine service work. Indeed, the impeller tends to be the major wear item in most pump assemblies. When disassembly is required, it can be accomplished quickly and easily with detachment of a band clamp and locking device. It is unnecessary to remove several bolts to reach the impeller, unlike conventional devices. The detachment process can be readily and quickly accomplished by both maintenance personnel and the ordinary consumer. The plastic pump of the present invention is substantially corrosion proof. In addition, there is no need for the "blueprinting" process to correct surface roughness and casting irregularities when the plastic pump is utilized.

Another feature of the present invention is the smooth curved contour of the intake housing, which is illustrated in FIG. 7. The intake housing gradually curves upward, as shown in FIG. 6, to direct the water, and there are no sharp corners to restrict the flow. Further, the contoured intake housing reduces the likelihood of undesirable cavitation. It accomplishes this by maximizing the water entrainment to the pump. By maximizing water entrainment and preventing air entrainment, performance of the watercraft is greatly improved. This is especially crucial during high performance maneuvers such as sharp cornering. Another effect of the minimization of cavitation is to decrease erosion effects on the impeller. This allows the impeller to be more reliable and to have a longer working life.

A further advantage of the present invention is that a wear ring is provided to surround the impeller and protect the pump housing. The wear ring of the present invention is inexpensive, light, and easy to replace. It is designed to be replaceable, and it has a tapered shape, so that it is easy to remove, which further facilitates maintenance efforts. By replacing the wear ring periodically, it is unnecessary to replace the entire intake housing of the pump. It thus provides for a better operating, more economical watercraft.

Another feature of novelty of the present invention is the provision of a flow restricter which directs water flow from the intake grill up into the intake housing and through the pump. It helps channel and direct the water efficiently. Also, various sized flow restricters can be used for different engine conditions, so that the flow restricter allows the engine to be fined-tuned according to the jet pump characteristics.

Yet another advantageous feature of the present invention is increased stability for the drive shaft assembly. The provision of plastic or rubber couplers and ball guides minimizes or eliminates misalignment of the drive shaft assembly. This, in turn, minimizes the likelihood of breakage of the shaft or other parts of the drive shaft assembly and increases the reliability of the watercraft.

A still further feature of novelty of the present invention is its vane design. The vane is designed to be light, consisting of only three webs and made from plastic. It is also designed to be easy to manufacture from a plastic mold.

These and other objects of the invention will become apparent from a consideration of the following specification and accompanying drawings which form a part of this application. In carrying out the objects of the invention, it is to be understood that its essential features are susceptible to change and design and structural arrangement, with only one preferred and practical embodiment being illustrated, as required.

DESCRIPTION OF THE PREFERRED EMBODIMENT

Figure 1:
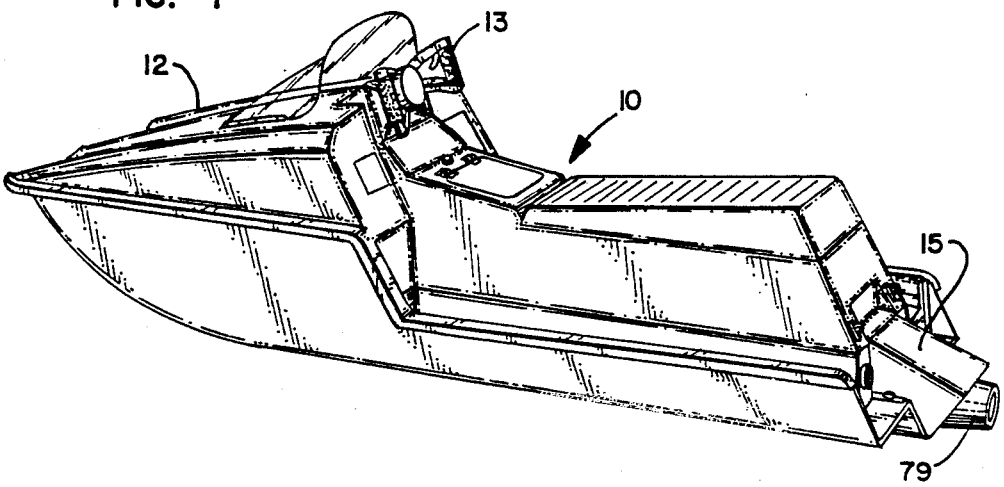
FIG. 1 is a perspective view of a water jet driven aquatic vehicle with which the intake and pump assembly of the present invention can be used.
Figure 2:
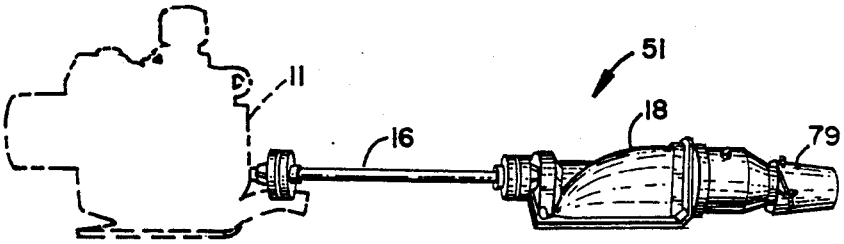
FIG. 2 is a side elevational view of a boat engine interconnected to the intake and pump assembly of the present invention.

Referring to the Drawings, an aquatic vehicle 10 suitable for use with the intake and pump assembly of the present invention is shown in FIG. 1. The engine 11 is preferably housed beneath the bow 12 of the boat 10. The operator of the craft 10 controls the direction of the vehicle by means of steering wheel 13, the steering wheel 13 being linked to a jet pump nozzle 14 located at the rear of the boat which is deflected to correspond to the movement of the steering wheel.

Figure 6:
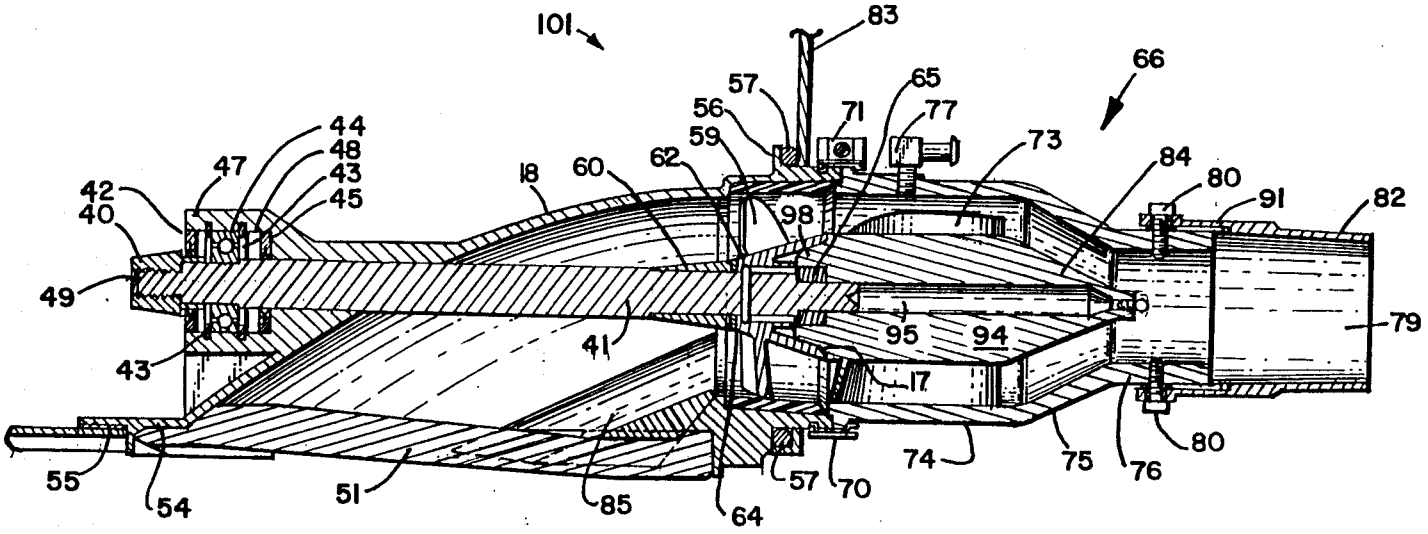
FIG. 6 is a side elevational view, partially in section, of the intake and pump assembly of the present invention.

The intake and pump assembly of the present invention, shown generally at 101 in FIG. 6, is preferably located on the underside of the boat 10, near the stern 83. It can be covered by a cover plate or pump guard 15 which is positioned above or below the water line and is located at the stern. During operation, the engine 11 drives a drive shaft 16 upon which is mounted an impeller 17 situated within the confines of the intake housing 18.

Figure 3:
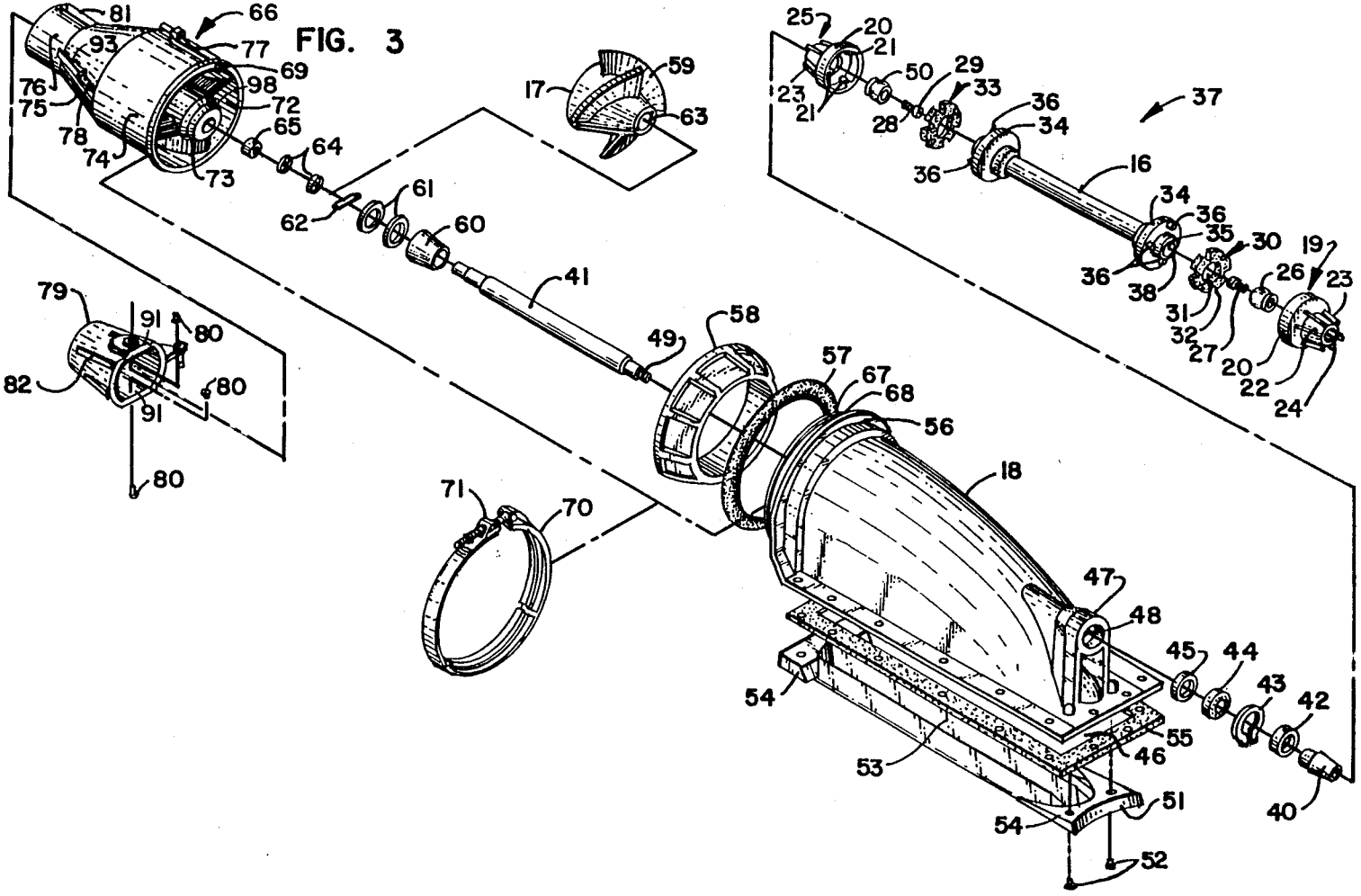
FIG. 3 is an exploded, diagrammatic, perspective view of the intake, pump assembly, and drive shaft assembly of the present invention.

The details of this engine-to-pump connection are illustrated in FIG. 3. The drive shaft assembly, which extends from a front drive coupling flange 19 to a rear drive coupling flange 25 is shown generally at 37. The drive shaft assembly 37 is symmetrical. The front drive coupling flange 19 connects with the engine 11 (not shown in FIG. 3). The drive coupling flange 19 includes an annular base portion 20 having a plurality of U-shaped notches 21 integrally formed therewithin. Preferably, there are three equally-spaced notches 21 located along the inner edge of the annular base portion 20. The drive coupling flange 19 also includes a cylindrical extension portion 22 integral with the annular base portion 20. The extension portion 22 has a plurality of ribs 23 integrally formed along its outside surface which provide additional structural support. A hole 24 extends longitudinally through the front drive coupling flange 19 and rear drive coupling flange 25. The component parts of the rear drive coupling flange 25 correspond exactly with the front drive coupling flange 19 and therefore have the same reference numerals. The front and rear drive coupling flanges 19, 25 are preferably made of aluminum or other suitable material.

Insertable within the drive coupling flange 19 is a front ball guide 26. The ball guide 26 has a hollow aperture extending axially through its center through which a front attachment bolt 27 is inserted. The inside of the ball guide 26 has a shoulder portion (not shown) against which the head of the attachment bolt 27 is positioned. The ball guide 26 is preferably made of a resilient plastic material such as Nylatron. The shaft 28 of the attachment bolt 27 is threaded. The shaft 28 is inserted through the aperture in the front ball guide 26, and then extends through the hole 24 in the front drive coupling flange 19. The hole 24 is sufficiently large for the shaft 28 of the attachment bolt 27. The shaft 28 of the front attachment bolt 27 extends through the cylindrical extension portion 22 of the drive coupling flange 19, so that the threaded portion of the shaft 28 can be attached to the engine 11. Similarly, the shaft 28 of the rear attachment bolt 29 extends through the rear drive coupling flange 25 for connection with the intake and pump assembly 101, as explained below. The rear attachment bolt 29 of the drive shaft assembly 37 corresponds to the front attachment bolt 27, and the rear ball guide 50 corresponds to the front ball guide 26.

A front coupler 30 fits within the base annular portion 20 of the front drive coupling flange 19. As illustrated in FIG. 3, the coupler 30 is substantially flat and circular in shape. It has a central aperture 31, and a plurality of U-shaped indentations 32 about its circumference. The circumferential indentations 32 could also be round or any other desired shape. In the preferred embodiment shown, there are a total of six indentations 32 on the coupler 30. The indentations 32 are sized and configured so that three of the indentations 32 will tightly fit around the three notches 21 in the drive coupling flange 19. It is to be understood that the number of indentations 32 and notches 21 could be varied. The outside diameter of the coupler 30 is substantially the same size as the inside diameter of the annular base portion 20 of the drive coupling flange 19 so as to fit tightly therewithin. Preferably, the front coupler 30 is made of a hard plastic material such as Santoprene, rubber, or other suitable material.

The rear coupler 33 corresponds exactly to the front coupler 30 in shape and configuration. However, in a preferred embodiment, the rear coupler 33 is made of a material which is relatively softer than the plastic material used for the front coupler 30, such as a rubber material or polyurethane.

The drive shaft 16 is preferably hollow and made of aluminum or other suitable material. It can be any desired length, depending on the distance between the engine 11 and intake and pump assembly 101. On each end of the drive shaft 16 are end pieces 34. The end pieces 34 are welded to the drive shaft 16 in the preferred embodiment, but any suitable method of attachment could be used. The end pieces 34 have an aperture 35 which corresponds in size with the aperture in the hollow drive shaft 16. Each end piece 34 also includes a central cylindrical connector piece 38 which has an inside diameter the size of the aperture 35 which extends through the end pieces 34 and drive shaft 16. Each end piece 34 includes a plurality, preferably three or more, of notches 36 of the same size and configuration as the notches 21 on the coupling flanges 19, 25. The notches 36 on the end pieces 34 are preferably integrally formed with the end piece itself and are preferably made of aluminum or other suitable material. The notches 36 on each end of the drive shaft 16 are sized and configured to fit tightly within the indentations 32 in the front coupler 30 and the rear coupler 33. The three notches 36 fit within the indentations 32 not already filled by the three notches 21 in the drive coupling flange 19 or 25. The cylindrical connector pieces 38 on the front and rear end pieces 34 fit within the annular space between the outer edge of the ball guide 26, 50 and the inner edge of the central aperture 31 in the couplers 30, 33.

Thus, three of the six indentations 32 in the front and rear couplers 30, 33 surround notches 21 in the drive coupling flanges 19, 25; and the other three indentations 32 surround the notches 36 on the end pieces 34 of the drive shaft 16. This provides a tight, secure connection of the various components of the drive shaft assembly 37. In addition, there is less likelihood of breakage of the drive shaft or other component parts, because the resilient couplers 30, 33 and ball guides 26, 50 absorb shock, vibrations, and misalignment of component parts.

Rotation of the drive shaft assembly 37 causes a rear drive shaft 41 located within the pump intake housing 18 to be rotated. To connect the drive shaft assembly 37 to the intake and pump assembly, the threaded shaft 28 of the rear attachment bolt 29 is insertable within a threaded adapter 40. The connection of the drive shaft assembly 37 to the rear drive shaft 41 is facilitated with the use of, from front to rear, the adapter 40, a front seal 42, a retainer ring 43, a bearing 44, and a rear seal 45, as illustrated in FIG. 3. Each of these parts has a central aperture through which the front end 49 of the rear drive shaft 41 is inserted, and each of these parts is positioned flush against the adjacent parts for a tight, secure shock-absorbing connection.

Figure 4:
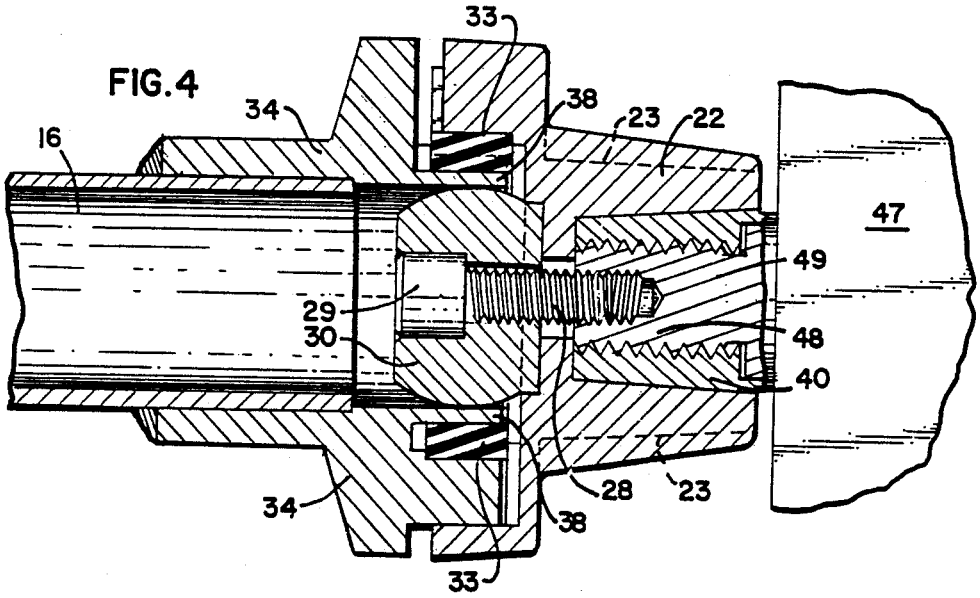
FIG. 4 is a side elevational view, partially in section, of the connection of the drive shaft assembly to the intake and pump assembly of the present invention.

Details of the engine-to-drive shaft connection and the drive shaft assembly-to-intake and pump assembly connection are illustrated in FIG. 4. The end of the shaft 28 of the rear attachment bolt 29 is inserted within the adapter 40, which has a central threaded aperture 48. The front end 49 of the rear drive shaft 41 is inserted through the front portion 47 of the intake housing 18 and into the threaded aperture 89 of the adapter 40. The end 49 of the rear drive shaft 41 is threaded on its outer surface to accommodate the threads of the aperture 48. The end 49 is also threaded on its inner surface to accommodate the threaded shaft 28 of the attachment bolt 29.

The reference numerals in FIG. 4 designate the rear portion of the drive shaft assembly. However, it is to be understood that the same connection is used for the frontal portion of the drive assembly, which connects to the engine 11. Therefore, the part indicated in FIG. 4 as reference numeral 47 could equally well designate the engine 11, and the parts designating the rear portion of the drive shaft are intended to also designate the corresponding portions of the front part of the symmetrical drive shaft assembly 37.

The intake housing 18 is made of a suitable lightweight material such as die-cast aluminum. It has a rounded, streamlined contour, and a rectangular opening 46 at its bottom. The walls of the intake housing 18 gradually enlarge to a greater cross-section toward the rear of the intake housing 18. The front end 47 of the intake housing 18 preferably has an arched portion 48 with an aperture 90 to accommodate the shaft 41.

Figure 7:
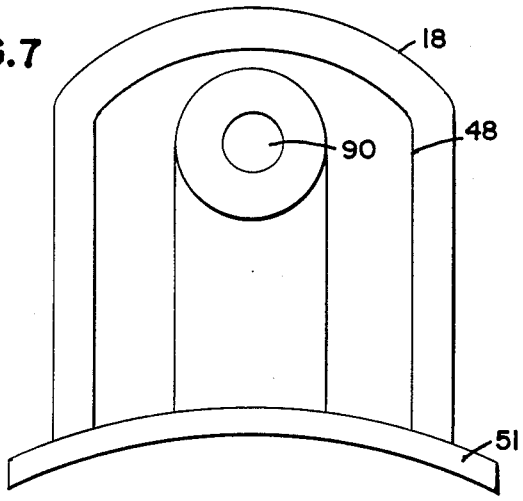
FIG. 7 is a rear end elevational view of the intake and pump assembly of the present invention.

An intake grill 51 is attached to the bottom of the intake housing 18 by a plurality of suitable fasteners 52 such as screws. A rectangular base gasket 55 interconnects the intake grill 51 with the bottom of the intake housing 18. The intake grill 51 has a substantially rectangular outer shape. As can be seen in FIG. 7, the intake grill 51 has a curved, concave configuration. It has a plurality of longitudinally extending, relatively thin streamlined fins 53. In the preferred embodiment, there are three fins 53. The fins 53 are spaced such that they provide a safety function by keeping out fingers, hands and feet from the interior of the intake and pump assembly 101. The fins 53 also substantially prevent the intake of rocks and debris into the intake and pump housing 10. The fins 53 have a rounded shape at their bottom, with the side edges converging to a point at the top similar to the shape of an airplane wing. In the preferred embodiment, the fins 53 are approximately one inch in width. The front and rear end portions 54 of the intake grill 89 are substantially flat and integral with the fins 53. The inner edge of the end portions 54 are curved in shape. The intake grill assembly is preferably made of a suitable lightweight material such as plastic.

The inside of the intake housing (not shown) is smooth and contoured to a rounded shape. Extending longitudinally through the inside of the intake housing 18 is the rear drive shaft 41. The intake housing 18 is preferably made of aluminum or other suitable material. The intake housing 18 is contoured to be substantially rounded in shape and gradually increases in size toward its rear end. A shoulder portion 56 having an L-shaped cross section is integrally attached to the outside of intake housing 18 at its rear end, with an annular lip portion 68 extending behind the shoulder portion 56. A rubber transom gasket 57 is positioned against the shoulder portion 56 of the intake housing. Preferably, the round transom gasket 57 is one-half inch in diameter.

An impeller 17 is mounted upon the rear drive shaft 41. The impeller 17 is preferably made of aluminum or other suitable material. The impeller 17 has a plurality of contoured fins 59 for channeling and directing the water through the pump.

A circular wear ring 58 is insertable within the intake housing 18 and surrounds the impeller 17. It is preferably made of aluminum or a plastic material. The wear ring 58 protects the pump housing 18 from wear and corrosion. As shown in FIG. 3, the diameter of the wear ring 58 is tapered to be smaller at its front end than at its rear end. This facilitates removal and replacement of the wear ring 58, and allows for quick and easy maintenance. The wear ring 58 is made of a lightweight, inexpensive material, so that the wear ring 58 can be replaced periodically, eliminating the necessity to replace the entire intake housing 18.

Interconnected to the rear end of the rear drive shaft 41 is nose piece 60. The nose piece 60 has an aperture for insertion of the rear end of the rear drive shaft 41 therethrough. Behind the nose piece 60 are located a plurality of adjusting washers 61. Preferably, these washers 61 are made of brass or other suitable material. The stacked washers 61 serve an adjustment or spacing function. As the impeller 17 or wear ring 58 eventually wears with use, the washers 61 are removable. By removing one or more of these stacked washers 61, the impeller 17 can be repositioned to maintain proper clearance. Located behind the adjusting washers 61 is a shear pin 62. In the alternative, a keyway (not shown) could be used in place of the shear pin 62. The shear pin 62 is insertable within the aperture 63 of the impeller 17. The impeller 17 has shoulder notches (not shown) for proper positioning of the shear pin 62. Behind the impeller 17 are located pump body seals 64 and a pump body bearing 65.

Figure 8:
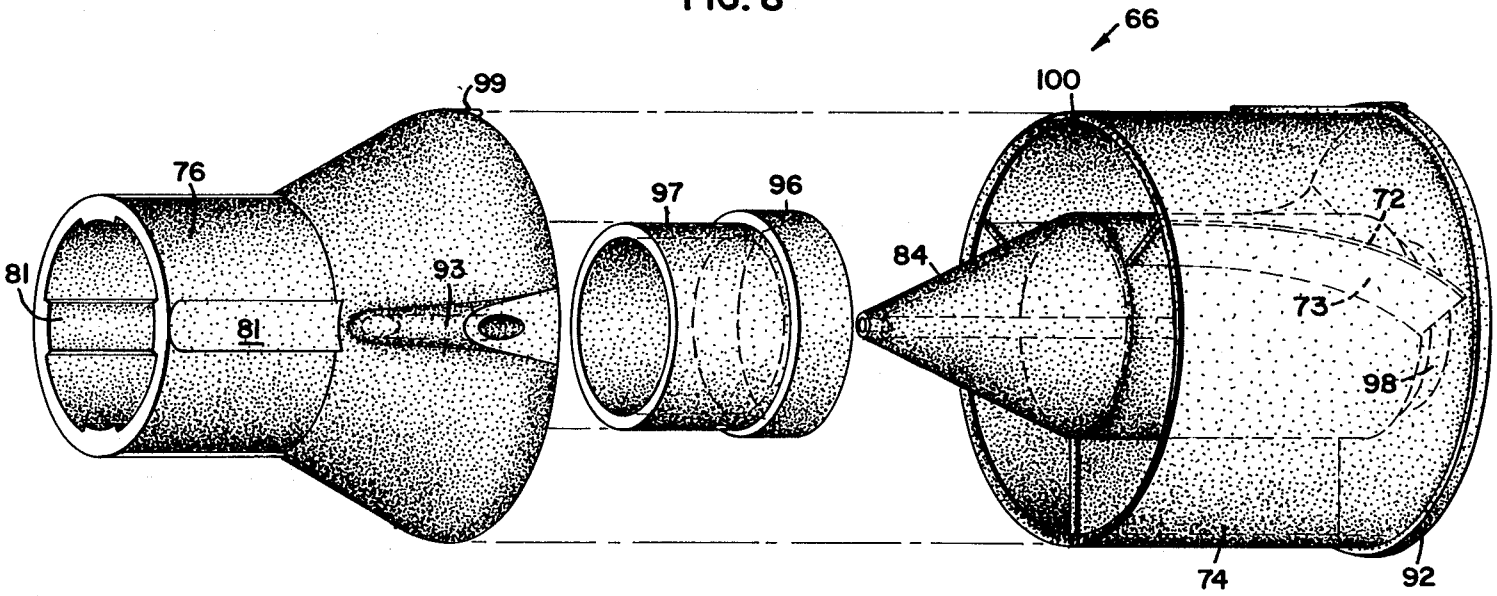
FIG. 8 is an exploded perspective view of the pump assembly of the present invention.
Figure 9:
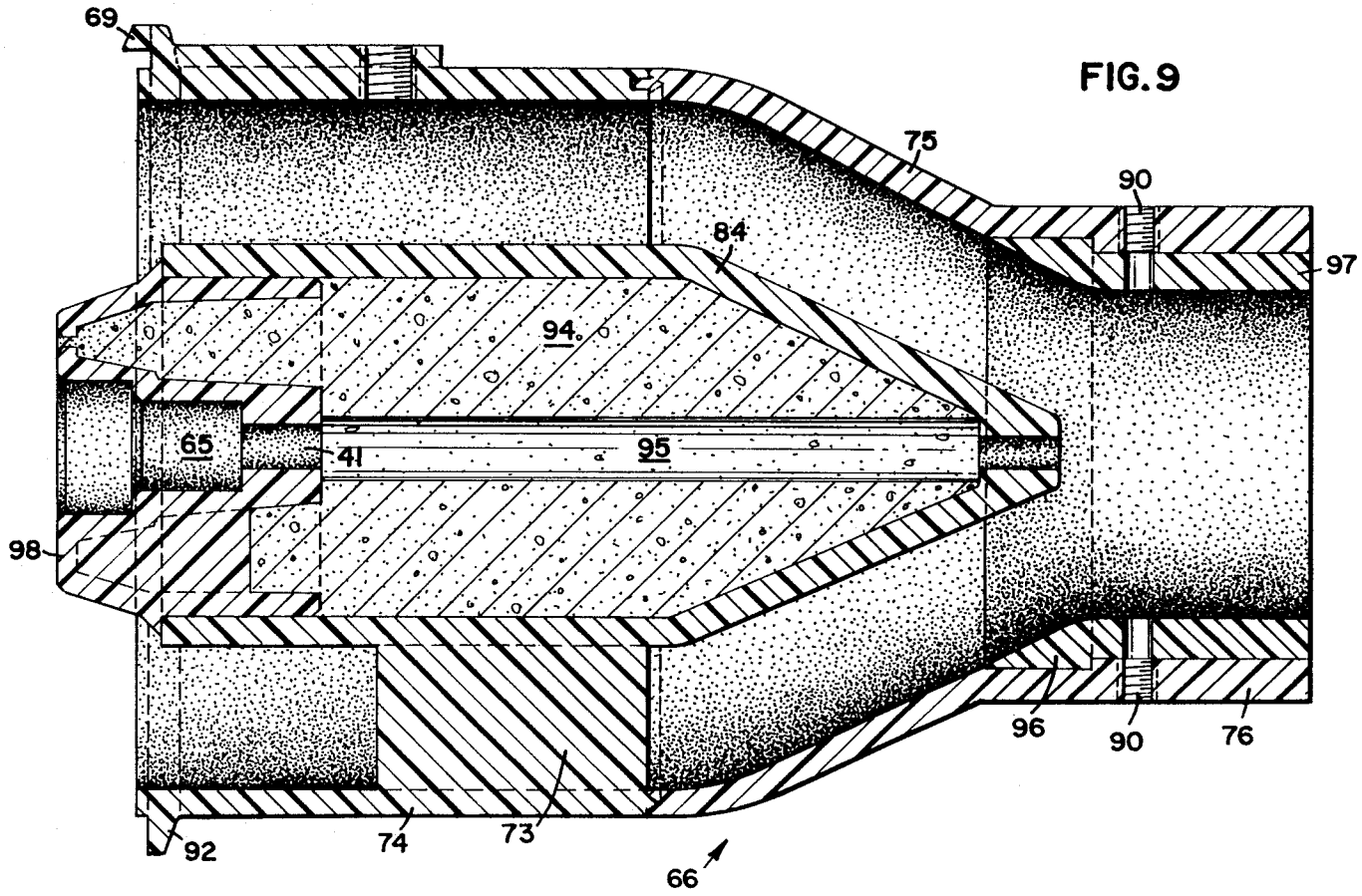
FIG. 9 is a side elevational, sectional view of the pump assembly of the present invention.

The pump body 66 is illustrated in the exploded view of FIG. 8 and in the sectional view of FIG. 9. The pump body 66 comprises a frontal, relatively large cylindrical portion 74, a central frustoconical portion 75, and a rear, relatively small cylindrical portion 76. In the preferred embodiment the pump body 66 is made of plastic, aluminum, or other suitable material. The contour of the pump body 66 is designed to maximize the efficiency with which the water flows through the pump and out through the rear nozzle 79 of the watercraft 10. A central, round extension portion 98 on the front end of the pump body 66 accommodates the bearing 65 and shaft 41. The extension portion 98 rests against the inside of the impeller body 17.

The pump body 66 contains a vane 72 within its front cylindrical portion 74. The vane 72 is stationary and serves to direct the high velocity water flow from the impeller. The vane 72 has a plurality of curved webs 73. The configuration of the webs 73 is illustrated in phantom in FIG. 8. In the preferred embodiment, the vane 72 has three webs 73. Preferably, the vane 72 is made of plastic, aluminum, or other suitable material, and it is formed integrally with the pump body 66. With the simple three-web design, the vane 72 is well suited to plastic injection molding and is easy to manufacture.

Inside the pump body 66 and behind the vane 72. a smooth conical portion 84 converges within the midsection 75 of the pump body 66 to direct the water flow out of the nozzle 79, as best illustrated in the cross-sectional views of FIGS. 6 and 9. Contained within the cylindrical portion 84 is a plastic material 94. The plastic material 94 is preferably a flowable material which is capable of being formed into a hardened mass after a period of curing. In the preferred embodiment, there is a longitudinal cavity 95 formed within the plastic material 94. The cavity 95 is capable of accommodating the end of the shaft 41, and can also accommodate a separate anchoring shaft (not shown). This allows the impeller 17 to be securedly mounted while being subjected to lateral forces as the watercraft moves along the water. The plastic material 94 serves to anchor the shaft 41 and impeller 17, and also prevents grit and other material from entering the conical portion 84.

A ring 97 is also provided for insertion within the rear section 76 of the pump body 66. The outside diameter of the ring 97 is slightly smaller than the inside of the rear portion 76 of the pump body 66. The ring 97 is preferably made of plastic or other suitable material. The ring 97 has a collar 96 on one end for a proper, tight fit within the pump body 66. The ring 97 serves to reduce the cross section of the channel in the rear end 76 of the pump body 66.

In the preferred embodiment, the frustoconical midsection 75 and rear portion 76 of the pump body 66 are made from a single, integral piece. The front end of the frustoconical portion 75 is interconnected to the large conical portion 74 of the pump body 66 by means of a male tab 99 and female notch 100. The components 74, 75 of the pump body 66 are then glued together in the preferred embodiment. In the alternative, the components 74, 75 can be operatively interconnected by suitable fasteners such as bolts (not shown).

The front end of the pump body 66 interconnects with the rear end of the intake housing 18. The intake housing 18 and pump body 66 are held together by a locking device which comprises a female notch 67 in the annular lip portion 68 on the rear of the intake housing 18, which receives a male locating tab 69 on the front annular lip portion 92 of the pump body 66. The tab 69 snaps into place in the notch 67 in order to position the pump body 66 and intake housing 18 correctly and to facilitate a secure attachment. The female notch 67 and male tab 68 can be located proximate the top of the intake housing 18 and pump body 66 respectively, as shown in FIG. 3.

A band clamp 70 is then placed around the seam between the intake housing 18 and the pump body 66. The band clamp 70 attaches directly behind the stern of the hull. The stern 83 of the boat is positioned between the transom gasket 57 and the band clamp 70 as illustrated in FIG. 6. The band clamp 70 has a screw and nut arrangement 71 which allows the band clamp 70 to be pulled apart at the screw and nut arrangement 71 to allow the band clamp 70 to be positioned around the intake housing-pump body connection. When properly positioned, the band clamp 70 is then tightened with the screw and nut arrangement 71.

This combination of the locking device and the band clamp makes disassembly of the pump assembly from the intake assembly easy for maintenance purposes. The disassembly is very quick, and the ordinary consumer can do it easily. In this manner, the wear ring 58 can be slid into place, the locking device can be engaged, and the band clamp 70 can be attached.

A tube 78 can be provided proximate the conical portion 75 of the pump body 66. The tube 78 is connected to a suitable integral fitting 93 on the pump body 66 which passes through the sides of the pump body's midsection 75. A low pressure venturi effect is created as the water passes by the tube 78. The tube 78 is used as a bilge pump to evacuate water from the hull. In addition, air can be drawn through the tube 78 from the boat's fuel tank compartment (not shown) toward the pump body 66. This air can be thereby evacuated from the fuel tank and passed out through the nozzle 79 along with the water which propels the boat. An elbow 77 can also be provided at the top of the pump body 66.

Steering is accomplished by a mechanical linkage (not shown) which causes the nozzle 79 to deflect to starboard for a starboard turn and to deflect to port for a port turn. The nozzle 79 is pivotally interconnected to the rear cylindrical portion 76 of the pump body 66 by a plurality of suitable fasteners 80 which are inserted through apertures 90 in the pump body 66. The nozzle 79 is preferably made of plastic, aluminum, or other suitable material. Its shape is tapered to be slightly smaller at its rearward end than at its forward end. The nozzle 79 has upper and lower flat portions 91 which are positioned flush against the outer surface of flat portions 81 on the cylindrical portion 76 of the pump body 66. Preferably, the outer body of the nozzle 79 has a plurality of longitudinal ribs 82.

Figure 5:
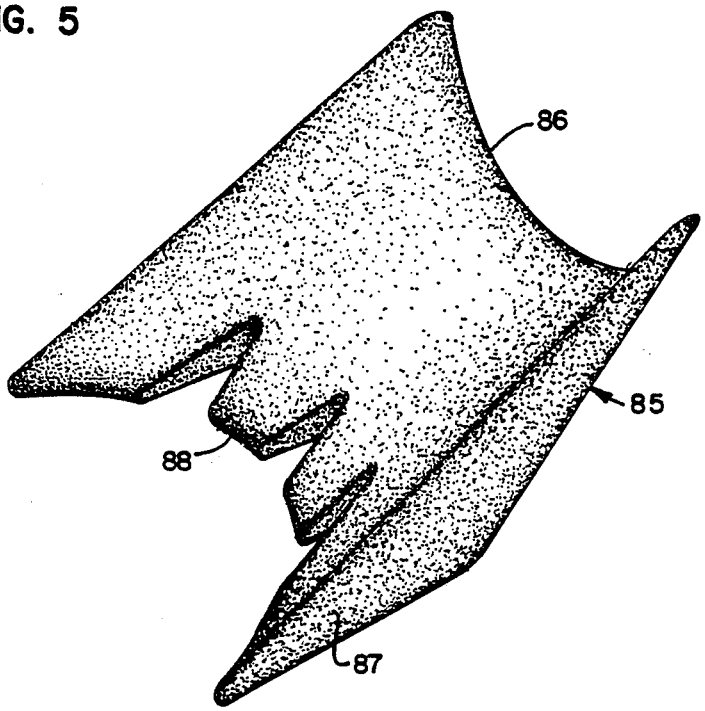
FIG. 5 is a perspective view of the flow restricter of the present invention.

Another feature of the present invention is a flow director or grill insert 85, illustrated in FIGS. 5 and 6. The flow director 85 is attached to the intake grill 89. The flow director 85 is mounted near the rear end of the intake grill 89 and is preferably glued to the intake grill 51. It has a substantially concave shape to correspond with the concave shape of the bottom of the intake housing 18. The concave shape of the flow director 85 serves to efficiently channel the water into the intake and pump assembly 10. It is situated within the intake housing of FIG. 6 in the position shown in FIG. 5, with the front end 86 of the flow director 85 being proximate the front end of the intake housing 18. The rear end 87 of the flow director 85 is substantially flat, and contains a plurality of baffles 88. The baffles 88 become thicker near the front portion 86 of the flow director 85. Preferably, the flow director 85 is made of plastic or other lightweight material. It is contoured to efficiently channel the water.

Further, different sized flow directors 85 can be installed and utilized for different conditions. In addition, the present invention can be utilized without a flow director 85. For example, a smaller flow director 85 may be desired for a different sized engine or for an engine running at a different RPM. A smaller sized flow director or grill insert 85 would allow a greater flow of water through the nozzle 79.

It is to be understood that numerous and various modifications can be readily devised in accordance with the principles of the present invention by those skilled in the art without departing from the spirit and scope of the invention. Therefore, it is not desired to restrict the invention to the particular constructions illustrated and described, but to cover all modifications that fall within the scope of the appended claims.

What is claimed is:

1. An intake and pump assembly for an aquatic vehicle of the type having a rotatable impeller mounted upon a drive shaft, comprising:

(a) a smooth streamlined intake housing having an opening through which water enters, said intake housing having a rear end proximate said impeller and an opposite front end;

(b) a removable wear ring surrounding said impeller, said wear ring being operatively connected proximate said rear end of said intake housing, wherein said wear ring has a tapered configuration to facilitate removal from said intake and pump assembly;

(c) a pump body operatively connected to said rear end of said intake housing and having an integral central vane therewithin which directs water around said vane and in a longitudinal direction from said impeller and through said pump body, said vane including a plurality of webs; and (d) a discharge nozzle operatively connected to said pump body through which a water jet is discharged to power the aquatic vehicle, said discharge nozzle being operatively connected to a steering mechanism.

2. An intake and pump assembly for an aquatic vehicle of the type having a rotatable impeller mounted upon a drive shaft, comprising:

(a) a smooth streamlined intake housing having an opening through which water enters, said intake housing having a rear end proximate said impeller and an opposite front end;

(b) a removable wear ring surrounding said impeller, said wear ring being operatively connected proximate said rear end of said intake housing;

(c) a pump body operatively connected to said rear end of said intake housing and having an integral central vane therewithin which directs water around said vane and in a longitudinal direction from said impeller and through said pump body, said vane including a plurality of webs, wherein said pump body is interconnected to said rear end of said intake housing by means of a notch on said intake housing and a corresponding locking tab on said pump body; and (d) a discharge nozzle operatively connected to said pump body through which a water jet is discharged to power the aquatic vehicle, said discharge nozzle being operatively connected to a steering mechanism.

3. An intake and pump assembly for an aquatic vehicle of the type having a rotatable impeller mounted upon a drive shaft, comprising:

(a) a smooth streamlined intake housing having an opening proximate a bottom end of said aquatic vehicle through which water enters, said intake housing having a rear end proximate said impeller and an opposite front end;

(b) an intake grill positioned over said opening in said intake housing, said intake grill including a plurality of streamlined fins;

(c) a removable plastic wear ring surrounding said impeller, said wear ring being operatively connected proximate said rear end of said intake housing;

(d) a pump body operatively connected to said rear end of said intake housing and having an integral central vane therewithin which directs water around said vane and in a longitudinal direction from said impeller and through said pump body, said vane terminating in a conical portion proximate a rear end of said vane;

(e) a discharge nozzle operatively connected to said pump body through which a water jet is discharged to power the aquatic vehicle, said discharge nozzle being operatively connected to a steering mechanism, and (f) means for directing water flow through said impeller and said pump housing, said flow director means being positioned within said intake housing, wherein said flow director means comprises a grill insert positioned upon said intake grill, said intake grill having a concave upper surface to direct water into said impeller.

4. An intake and pump assembly for an aquatic vehicle of the type having a rotatable impeller mounted upon a drive shaft, comprising:

(a) a smooth streamlined intake housing having an opening proximate a bottom end of said aquatic vehicle through which water enters, said intake housing having a rear end proximate said impeller and an opposite front end;

(b) an intake grill positioned over said opening in said intake housing, said intake grill including a plurality of streamlined fins;

(c) a removable plastic wear ring surrounding said impeller, said wear ring being operatively connected proximate said rear end of said intake housing, wherein said wear ring has a tapered configuration to facilitate removal from said intake and pump assembly;

(d) a pump body operatively connected to said rear end of said intake housing and having an integral central vane therewithin which directs water around said vane and in a longitudinal direction from said impeller and through said pump body, said vane terminating in a conical portion proximate a rear end of said vane; and (e) a discharge nozzle operatively connected to said pump body through which a water jet is discharged to power the aquatic vehicle, said discharge nozzle operatively connected to a steering mechanism.

5. An intake and pump assembly for an aquatic vehicle of the type having a rotatable impeller mounted upon a drive shaft, comprising:

(a) a smooth streamlined intake housing having an opening proximate a bottom end of said aquatic vehicle through which water enters, said intake housing having a rear end proximate said impeller and an opposite front end;

(b) an intake grill positioned over said opening in said intake housing, said intake grill including a plurality of streamlined fins;

(c) a removable plastic wear ring surrounding said impeller, said wear ring being operatively connected proximate said rear end of said intake housing;

(d) a pump body operatively connected to said rear end of said intake housing and having an integral central vane therewithin which directs water around said vane and in a longitudinal direction from said impeller and through said pump body, said vane terminating in a conical portion proximate a rear end of said vane;

(e) a discharge nozzle operatively connected to said pump body through which a water jet is discharged to power the aquatic vehicle, said discharge nozzle being operatively connected to a steering mechanism; and (f) a drive shaft assembly, said drive shaft assembly including at least one coupler of resilient material which interconnects component parts of said drive shaft assembly and which absorbs shock and misalignment, wherein said coupler includes a plurality of indentations for receiving corresponding notches in said component parts of said drive shaft assembly in order to interconnect said component parts.

6. An intake and pump assembly for an aquatic vehicle of the type having a rotatable impeller mounted upon a drive shaft, comprising:

(a) a smooth streamlined intake housing having an opening proximate a bottom end of said aquatic vehicle through which water enters, said intake housing having a rear end proximate said impeller and an opposite front end;

(b) an intake grill positioned over said opening in said intake housing, said intake grill including a plurality of streamlined fins;

(c) a removable plastic wear ring surrounding said impeller, said wear ring being operatively connected proximate said rear end of said intake housing;

(d) a pump body operatively connected to said rear end of said intake housing and having an integral central vane therewithin which directs water around said vane and in a longitudinal direction from said impeller and through said pump body, said vane terminating in a conical portion proximate a rear end of said vane, wherein said pump body is interconnected to said rear end of said intake housing by means of a notch on said intake housing and a corresponding locking tab on said pump body; and (e) a discharge nozzle operatively connected to said pump body through which a water jet is discharged to power the aquatic vehicle, said discharge nozzle being operatively connected to a steering mechanism.

* * * * *